US011674647B2

(12) United States Patent
Shao

(10) Patent No.: US 11,674,647 B2
(45) Date of Patent: Jun. 13, 2023

(54) LAMP

(71) Applicants: OPPLE LIGHTING CO., LTD., Shanghai (CN); SUZHOU OPPLE LIGHTING CO., LTD., Suzhou (CN)

(72) Inventor: Jie Shao, Suzhou (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/564,070

(22) Filed: Dec. 28, 2021

(65) Prior Publication Data

US 2022/0120393 A1 Apr. 21, 2022

Related U.S. Application Data

(63) Continuation of application No. PCT/CN2020/119235, filed on Sep. 30, 2020.

(30) Foreign Application Priority Data

Oct. 28, 2019 (CN) ..... 201921819238.1

(51) Int. Cl.

| | |
|---|---|
| ***F21S 6/00*** | (2006.01) |
| ***F21V 21/06*** | (2006.01) |
| ***F21V 21/28*** | (2006.01) |

(52) U.S. Cl.

CPC ..... *F21S 6/003* (2013.01); *F21V 21/06* (2013.01); *F21V 21/28* (2013.01)

(58) Field of Classification Search

CPC ..... F21S 6/003; F21V 21/06; F21V 21/28

See application file for complete search history.

(56) References Cited

U.S. PATENT DOCUMENTS

| | | | | |
|---|---|---|---|---|
| 10,656,421 | B2 | 5/2020 | Piskunov et al. | |
| 2010/0296264 | A1* | 11/2010 | Ronda | F21S 6/003 362/311.06 |
| 2013/0051025 | A1 | 2/2013 | Lai | |
| 2013/0329431 | A1* | 12/2013 | Lin | F21S 6/003 362/253 |

(Continued)

FOREIGN PATENT DOCUMENTS

| | | | |
|---|---|---|---|
| CN | 202040639 | A | 11/2011 |
| CN | 105259605 | A | 1/2016 |
| CN | 107606513 | A | 1/2018 |

(Continued)

OTHER PUBLICATIONS

International Search Report of PCT Application No. PCT/CN2020/119235 dated Dec. 30, 2020 with English translation, (6p).

*Primary Examiner* — Anne M Hines

(74) *Attorney, Agent, or Firm* — Arch & Lake LLP

(57) ABSTRACT

A lamp includes a bracket assembly and a lamp cap movably mounted on the bracket assembly. The bracket assembly includes a plurality of lamp poles movably connected so that the lamp cap moves in a first movement path thereof. The lamp cap is configured to move in a second movement path thereof relative to the lamp pole on which it is carried, where the first movement path is different from the second movement path. The lamp cap of the lamp according to the present application has two different movement paths.

13 Claims, 6 Drawing Sheets

(56) References Cited

U.S. PATENT DOCUMENTS

| | | | |
|---|---|---|---|
| 2017/0045745 | A1 | 2/2017 | Piskunov et al. |
| 2018/0058647 | A1* | 3/2018 | He ..... F21V 21/116 |

FOREIGN PATENT DOCUMENTS

| | | | |
|---|---|---|---|
| CN | 208331882 | U | 1/2019 |
| CN | 209445138 | U | 9/2019 |
| CN | 209445140 | U | 9/2019 |
| CN | 210373003 | U | 4/2020 |

* cited by examiner

LAMP

CROSS-REFERENCE TO RELATED APPLICATIONS

This application is a continuation of PCT patent application No. PCT/CN2020/119235 filed on Sep. 30, 2020 which is based upon and claims priority to Chinese patent application No. 201921819238.1 filed on Oct. 28, 2019, the entire contents of which are hereby incorporated by reference herein for all purposes.

TECHNICAL FIELD

The present application relates to the field of illumination, and particularly to a lamp.

BACKGROUND

In daily life, a desk lamp, as a domestic appliance for illumination, has the function of focusing the light of the lamp into a small area to facilitate work and study.

A conventional desk lamp emits light in a straight down manner to prevent eyes from looking straight at a luminous surface and dazzle light, which, however, results in an oversized lamp cap. In order to protect a user from the risk of hitting against the lamp cap, the body of the lamp is usually provided with a polarized lens to constitute a polarized desk lamp, which moves the optimal lighting area away from the position just below the center of the lamp cap. Nevertheless, this results in that the lamp cap and the base of the desk lamp are relatively fixed, which does not allow for more adjustment and causes inconvenience in use.

SUMMARY OF THE INVENTION

In order to solve the aforesaid problems, the present application provides a lamp. A lamp cap of the lamp according to the present application has two different movement paths. Thus, in use of the lamp, it reduces the limit to adjustment of the position of the lamp cap and expands the usage scenario and the lighting range of the lamp.

The lamp according to the present application includes a bracket assembly and a lamp cap movably mounted on the bracket assembly, wherein the bracket assembly includes a plurality of lamp poles movably connected so that the lamp cap moves in a first movement path thereof, the lamp cap is configured to move in a second movement path thereof relative to the lamp pole on which it is carried, and the first movement path is different from the second movement path.

BRIEF DESCRIPTION OF THE DRAWINGS

The drawings described herein are used to provide further understanding of the present application and constitute a part of the present application. Illustrative embodiments of the present application and description thereof are used to explain the present application, and do not constitute any improper limit to the present application. In the drawings.

DETAILED DESCRIPTION

In order to make the objective(s), the technical solution(s) and advantages of the present application more apparent, the technical solution(s) of the present application will be described clearly and completely with reference to embodiments of the present application and corresponding drawings hereinafter. It will be apparent that the embodiments described are only some but not all of the embodiments of the present application. Based on the embodiments in the present application, all the other embodiments obtained by those of ordinary skill in the art without making inventive efforts should also fall within the scope claimed by the present application.

Figure 1:
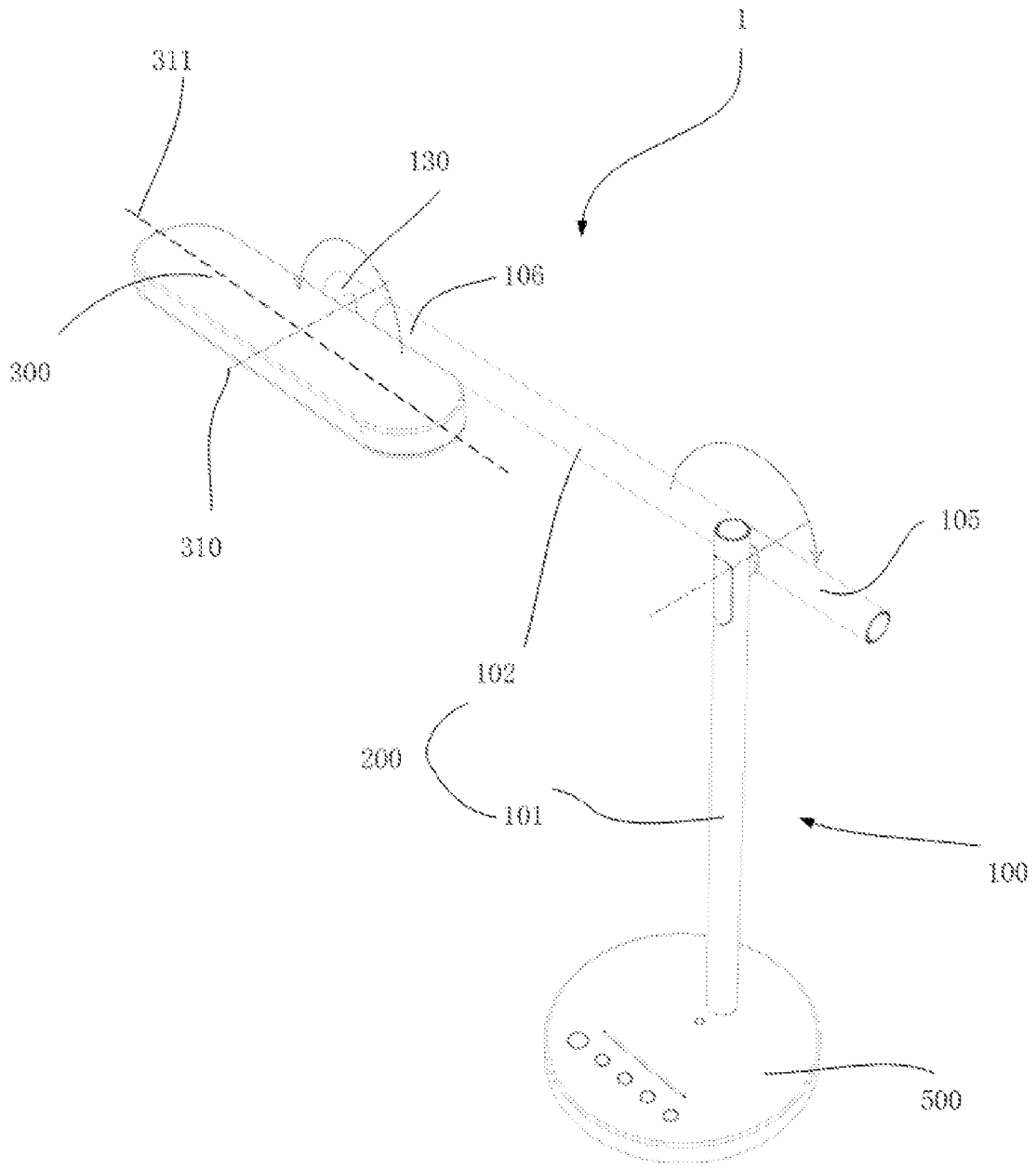
FIG. 1 schematically shows an overall structure of a lamp according to an embodiment of the present application.

FIG. 1 schematically shows an overall structure of a lamp 1 according to an embodiment of the present application. As shown in FIG. 1, the lamp 1 includes a bracket assembly 100 and a lamp cap 300 movably mounted on the bracket assembly 100. The bracket assembly 100 includes a plurality of lamp poles 200 (e.g., a first lamp pole 101 and a second lamp pole 102) movably connected so that the lamp cap 300 moves in a first movement path thereof. The lamp cap 300 is configured to move in a second movement path thereof relative to the lamp pole on which it is carried. The first movement path is different from the second movement path.

The lamp cap 300 of the lamp 1 according to the present application has two movement paths, i.e., the first movement path and the second movement path. Thus, in use of the lamp 1, it reduces the limit to adjustment of the position of the lamp cap 300 and expands the usage scenario and the lighting range of the lamp 1. In actual use of the lamp 1, by adjusting the relative position between the plurality of lamp poles 101, 102 and the lamp cap 300 to coordinate the first movement path and the second movement path of the lamp cap 300, the lamp cap 300 or a lighting area thereof can be conveniently adjusted to a proper position so as to improve the use experience of the user and the lighting effect. When the lamp cap 300 is a polarized lamp cap, the lamp 1 can be used as a polarized desk lamp. As for the polarized desk lamp, the first movement path and the second movement path of the polarized lamp cap assist the user in moving the lighting range of the lamp to a desired position more conveniently, thus providing the user with significant convenience in use.

In one embodiment, both the first lamp pole 101 and the second lamp pole 102 are metal parts, e.g., metal tubes. In a more preferred embodiment, both the first lamp pole 101 and the second lamp pole 102 are aluminum tubes, which contributes to reduce the weight of the lamp 1 so as to make it convenient for the user to move the lamp 1.

In one embodiment, the plurality of lamp poles include the first lamp pole 101 and the second lamp pole 102 movably connected, and the lamp cap 300 is movably connected to the second lamp pole 102. In the first movement path, the lamp cap 300 moves towards or away from the first lamp pole 101; and in the second movement path, the lamp cap 300 rotates about a first axis 310 thereof so as to adjust the light emitting direction thereof to a predetermined direction. According to this structure, the first movement path of the lamp cap 300 is greater than the second movement path. In other words, the lamp cap 300 can be adjusted, as a whole, to a desired position through the first movement path, and then the light emitting direction of the lamp cap 300 is precisely adjusted to the predetermined direction through the second movement path. This can help the user to adjust the lamp 1 rapidly according to the usage environment and requirements so as to improve the use experience of the user.

Figure 3:
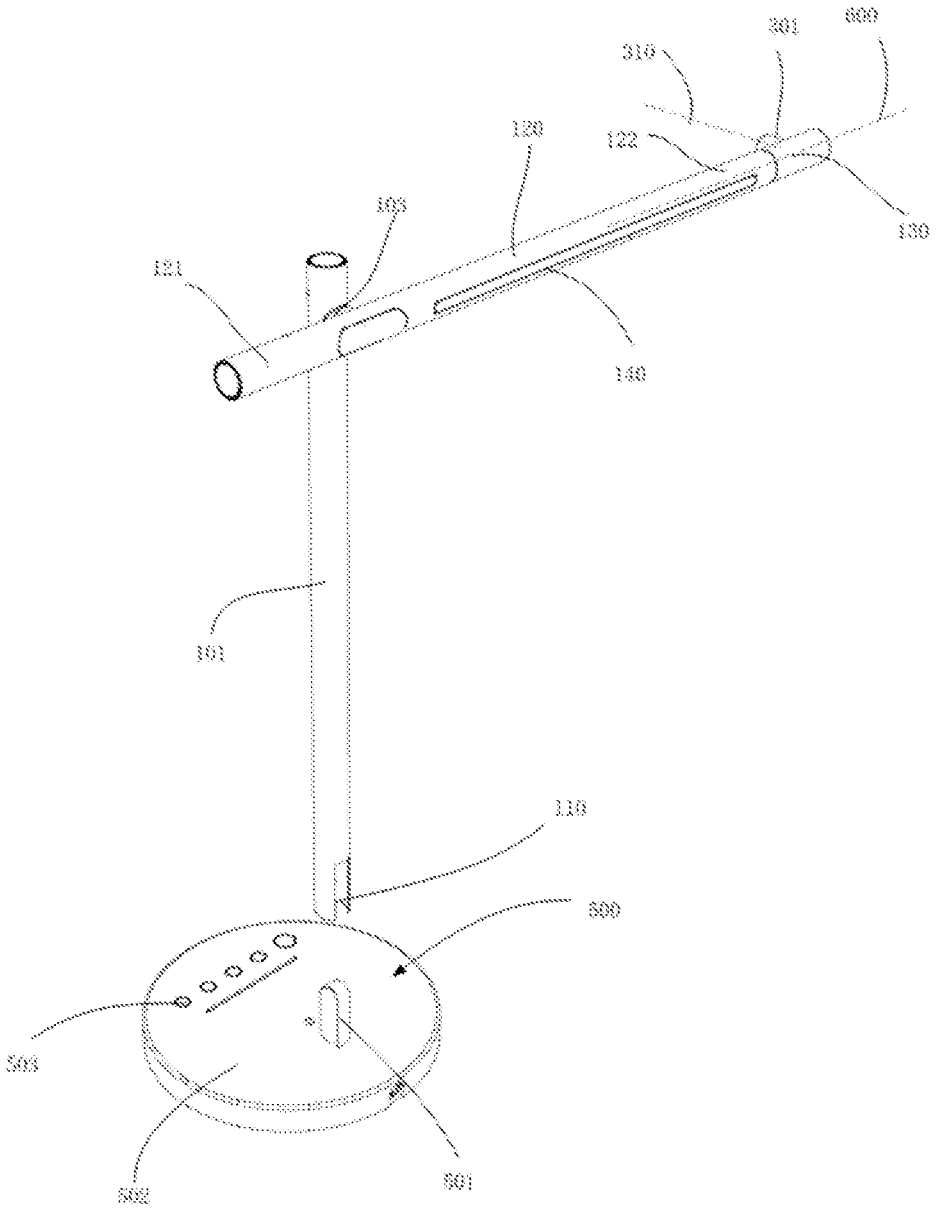
FIG. 3 schematically shows a bracket assembly of a lamp.

In a specific embodiment, as shown in FIG. 3, the first lamp pole 101 and the second lamp pole 102 are connected through a first pivot 103, and the lamp cap 300 is connected to the second lamp pole 102 through a second pivot 301. The first pivot 103 is perpendicular to an axial direction of the first lamp pole 101 and the second lamp pole 102 so that the lamp cap 300 rotates in the first movement path; and the second pivot 301 is perpendicular to the axial direction of the second lamp pole 102 so that the lamp cap 300 rotates in the second movement path. In this structure, the lamp cap 300 rotates about the first pivot 103 to form the first movement path thereof, the first axis 310 of the lamp cap 300 coincides with the second pivot 301, and the lamp cap 300 rotates about the second pivot 301 to form the second movement path thereof. Such adjustment by rotation is simple to carry out, thus providing convenience for the user to use the lamp 1.

Figure 2A:
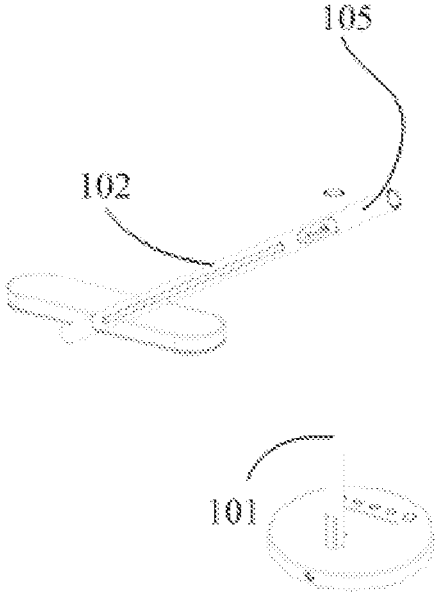
FIGS. 2A, 2B and 2C schematically show different statuses of the lamp in FIG. 1.
Figure 2B:
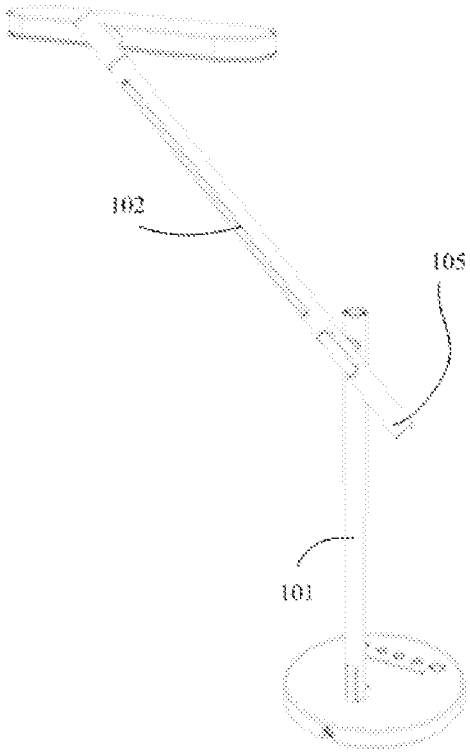
Figure 2C:
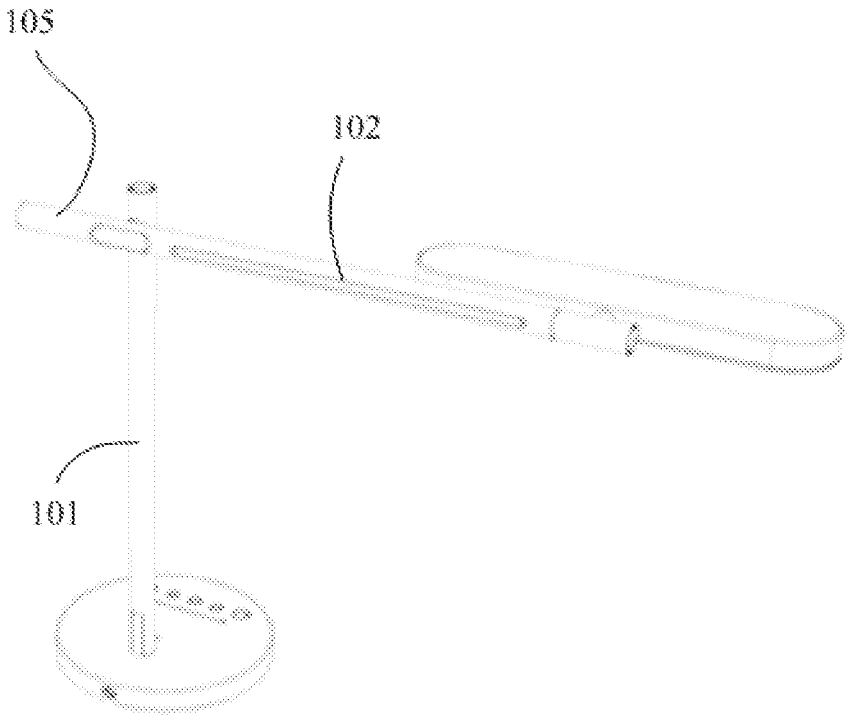

More specifically, the first lamp pole 101 is a vertical lamp pole, the second lamp pole 102 has a first end 105 connected to the first lamp pole 101 through the first pivot 103, and the lamp cap 300 is connected to a second end 106 of the second lamp pole 102 through the second pivot 301. In one embodiment, during use of the lamp 1, the first lamp pole 101 cannot rotate (i.e., it forms a vertical and fixed lamp pole), and the second lamp pole 102 can rotate relative to the first lamp pole. Thereby, in actual use of the lamp 1, the lamp 1 can be fixedly disposed at a certain position through the first lamp pole 101, and then the lighting area of the lamp cap 300 is adjusted to a proper position or the light emitting direction of the lamp cap 300 is adjusted to a predetermined direction through a rotation of the second lamp pole 102 and a rotation of the lamp cap 300. When the lamp 1 is used as a desk lamp, the first lamp pole 101 can be mounted in a lamp socket 500 of the lamp 1 and serves as a support rod of the desk lamp 1 so that this structure and the adjustment manner are particularly suitable. FIGS. 2A, 2B and 2C schematically show the adjustment manner of the lamp 1. As shown in FIG. 2A, the first lamp pole 101 is a vertical and fixed lamp pole, the second lamp pole 102 is at a first side of the first lamp pole 101 and forms an acute angle with the first lamp pole 101, and the lamp cap 300 has a height lower than the first end 105 of the second lamp pole 102 and has a downward, light emitting direction. As compared to FIG. 2A, in FIG. 2B, the second lamp pole 102 is rotated in such a manner that the second lamp pole 102 is still at the first side of the first lamp pole 101 and forms an obtuse angle with the first lamp pole 101, and the lamp cap 300 is adaptively adjusted to have a height higher than the first end 105 of the second lamp pole 102 and keep the downward, light emitting direction. As compared to FIGS. 2A and 2B, in FIG. 2C, the second lamp pole 102 is rotated again in such a manner that the second lamp pole 102 is at a second side of the first lamp pole 101 and forms a right angle with the first lamp pole 101, and the lamp cap 300 is adaptively adjusted to have a height equal to the first end 105 of the second lamp pole 102 and keep the downward, light emitting direction.

In some other embodiments, a length of the first lamp pole 101 is smaller than that of the second lamp pole 102. For a desk lamp, the shorter first lamp pole 101 can control the desk lamp to have a proper height so as to guarantee the lighting effect of the lamp 1. For example, the first lamp pole 101 may have a length of 400 mm. The longer second lamp pole 102 can allow for a larger adjustment range of the lamp cap 300 so as to provide convenience for the user to use the lamp 1.

In one embodiment, the rotation angle between the second lamp pole 102 and the first lamp pole 101 is greater than or equal to 0° but smaller than or equal to 300°; and the rotation angle between the lamp cap 300 and the second lamp pole 102 is greater than or equal to 0° but smaller than or equal to 300°. Such rotation angles can not only achieve adjustment of the lamp cap 300 but also prevent a movement interference from occurring between the lamp cap 300 and the first lamp pole 101 so as to protect the lamp cap 300.

Also, as shown in FIG. 3, the second lamp pole 102 includes a lamp pole body 120, which has a head end 121 connected to the first lamp pole 101 through the first pivot 103 and has a tail end 122 rotatably provided with a rotating head 130; and the lamp cap 300 is connected to the rotating head 130 through the second pivot 301. The rotating head 130 has a rotation axis 600 parallel to the axial direction of the second lamp pole 102. Thus, the rotating head 130 can enable the lamp cap 300 to have a third movement path different from the first movement path and the second movement path. As shown in FIG. 3, a second axis 311 of the lamp cap 300 is perpendicular to the first axis 310 and parallel to the axial direction of the second lamp pole 102. Thus, when viewed as a whole, the second movement path is substantially orthogonal to the third movement path. In this way, the adjustment range of the lamp cap 300 is further extended, which further provides convenience for the user in use.

In one embodiment, in the third movement path, the rotation angle of the lamp cap 300 is smaller than or equal to 180°. Thus, the light emitted from the lamp cap 300 can be substantially prevented from directly entering the user's eyes so as to protect the user.

Figure 4:
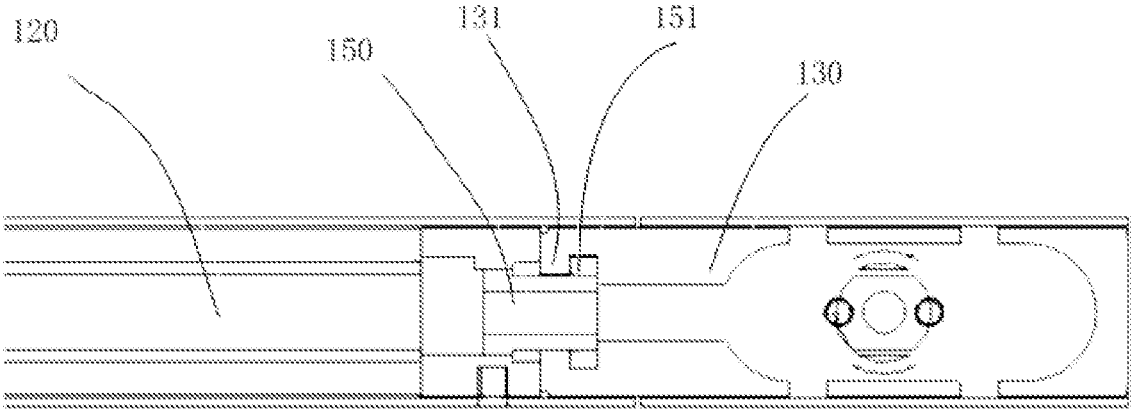
FIG. 4 schematically shows a cooperated manner between a lamp pole body of a second lamp pole and a rotating head.

FIG. 4 schematically shows a cooperation between the lamp pole body 120 and the rotating head 130 of the second lamp pole 102. As shown in FIG. 4, a bearing shaft 150 is axially mounted at the tail end 122 of the lamp pole body 120, and a block 151 extending radially and outwardly is provided at a distal end of the bearing shaft 150. The rotating head 130 has a flange plate 131 extending radially and inwardly, the flange plate 131 rotatably cooperates with the bearing shaft 150 and is axially limited by the block 151. Thus, the rotating head 130 can rotate about the bearing shaft 150 as an axis through the flange plate 131 so that the lamp cap 300 rotates in the third movement path.

In one embodiment, a light emitter 140 is provided on the lamp pole. For example, the light emitter 140 is provided on the lamp pole body 120 of the second lamp pole 102. In a specific embodiment, the light emitter 140 may be an LED luminous module. The light emitter 140 can be used for indication or used as a night light, which further provides convenience for the user in use. In some other embodiments, the light emitter 140 may also be provided on the first lamp pole 101.

Still, as shown in FIG. 3, the first lamp pole 101 is rotatably mounted in the lamp socket 500. In another embodiment, a protruding post 501 is provided in the lamp socket 500, and a gap 110 matched with the protruding post 501 is provided at a mounting end of the first lamp pole 101. Furthermore, a rotation shaft (not shown) is further mounted between the protruding post 501 and the mounting end of the first lamp pole 101 so that the first lamp pole 101 can rotate relative to the protruding post 501 (or the lamp socket 500). Preferably, the rotation angle between the first lamp pole 101 and the lamp socket 500 is smaller than or equal to 90°.

Thus, after being mounted on the protruding post 501, the first lamp pole 101 can move towards or away from the lamp socket 500 by means of the gap 110. In this way, during packaging of the lamp 1, the first lamp pole 101 can be rotated to be attached with the lamp socket 500; meanwhile, the second lamp pole 102 is rotated to have a minimum included angle with the first lamp pole 101; and the lamp cap 300 and the second lamp pole 102 have a minimum included angle therebetween. When viewed as a whole, the entire lamp 1 is folded up so that the lamp 1 can have a very small volume and thus have a reduced packaging volume, thereby reducing the packaging materials and the packaging costs.

In a specific embodiment, the lamp socket 500 further includes a housing 502 and a control module (not shown) disposed within the housing 502, and a control button 503 electrically connected to the control module is provided on the housing 502 in order to facilitate control of the light emission status of the lamp cap 300. In some other embodiments, the control button 503 may also be a hidden touch button. In some other embodiments, a remote-control receiving module may be disposed within the lamp socket 500 so as to remotely control the light emission status of the lamp cap 300. The protruding post 501 is formed on the housing 502. In some other embodiments, the housing 502 is made of plastic and metal, and the protruding post 501 is made of metal.

Figure 5:
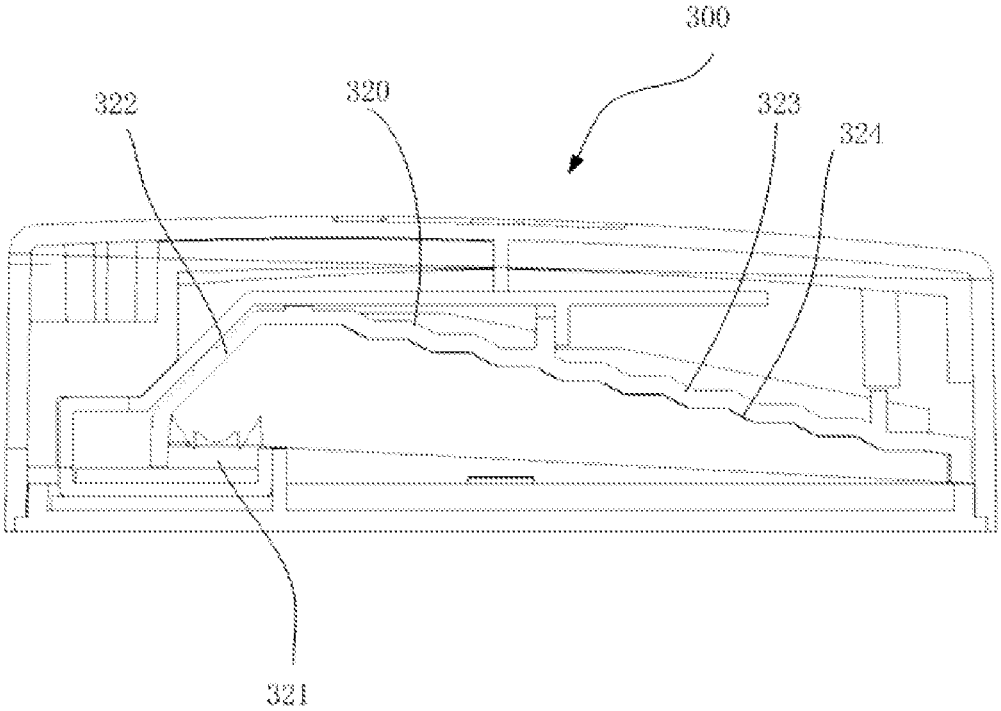
FIG. 5 schematically shows a structure of a lamp cap.

FIG. 5 schematically shows the structure of the lamp cap 300. As shown in FIG. 5, the lamp cap 300 includes a light guide element 320 and a light source 321 eccentrically disposed within the light guide element 320. In one embodiment, the light guide element 320 is a reflecting mirror. This arrangement of the light source 321 may be understood as follows: when a lampshade 320 has a sphere, a hemisphere or a regular polyhedron shape as a whole, the light source 321 is disposed to deviate from the sphere center of the lampshade 320; and when the lampshade 320 has an irregular shape as a whole, the light source 321 is disposed to be adjacent to a side wall of the light guide element 320. In this way, the light guide element 320 can transfer the optimal lighting area of the light source 321 from a position just below the light source 321 to other positions. When viewed as a whole, the light guide element 320 is a polarized lens and the lamp cap 300 is formed as a polarized lamp cap.

Figure 6:
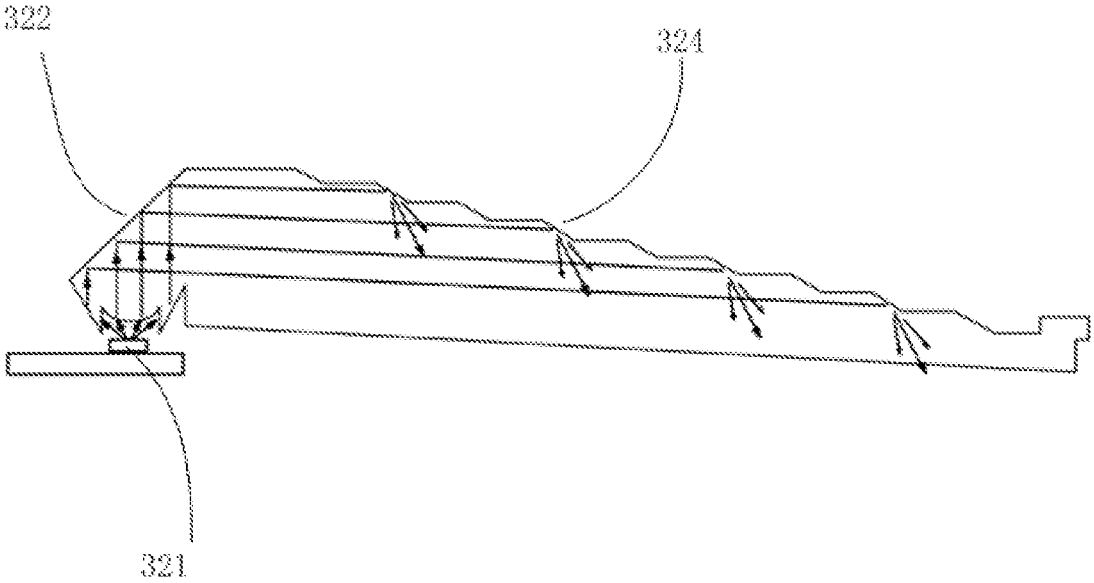
FIG. 6 schematically shows a light path structure within a lamp cap.

In a preferred embodiment, the light guide element 320 includes a first reflecting area 322 with a slope face and a second reflecting area 323 with a plurality of stepped faces 324. Within the lamp cap 300, the first reflecting area 322 is adjacent to the light source 321, and the second reflecting area 323 extends away from the light source 321. The light path structure within the lamp cap 300 is shown in FIG. 6. The first reflecting area 322 guides the light of the light source 321 to the second reflecting area 323, and the plurality of stepped faces 324 of the second reflecting area 323 respectively guide the light from the first reflecting area 322 to exit the lamp cap 300. In this way, these stepped faces 324 transfer the optimal lighting area of the light source 321 from the position just below the light source 321 to other positions.

In a specific embodiment, the light guide element 320 is a plastic product with a high reflectivity, and the light source 321 is an LED.

In one embodiment, the plurality of lamp poles include a first lamp pole and a second lamp pole movably connected, the lamp cap is movably connected to the second lamp pole, the lamp cap moves towards or away from the first lamp pole in the first movement path, and the lamp cap rotates about a first axis thereof in the second movement path.

In one embodiment, the first lamp pole and the second lamp pole are connected through a first pivot, the lamp cap is connected to the second lamp pole through a second pivot, the first pivot is perpendicular to an axial direction of the first lamp pole and the second lamp pole so that the lamp cap rotates in the first movement path thereof, and the second pivot is perpendicular to the axial direction of the second lamp pole so that the lamp cap rotates in the second movement path thereof.

In one embodiment, the first lamp pole is a vertical lamp pole, the second lamp pole has a first end connected to the first lamp pole through the first pivot, and the lamp cap is connected to a second end of the second lamp pole through the second pivot.

In one embodiment, a rotation angle between the second lamp pole and the first lamp pole is greater than or equal to 0° but smaller than or equal to 300°; and a rotation angle between the lamp cap and the second lamp pole is greater than or equal to 0° but smaller than or equal to 300°.

In one embodiment, the second lamp pole includes a lamp pole body, the lamp pole body has a head end connected to the first lamp pole through the first pivot and has a tail end rotatably provided with a rotating head, the lamp cap is connected to the rotating head through the second pivot, the rotating head has a rotation axis parallel to the axial direction of the second lamp pole so that the lamp cap moves along a third movement path thereof, and the third movement path is different from the first movement path and the second movement path.

In one embodiment, a bearing shaft is axially mounted at the tail end of the lamp pole body, a block extending radially and outwardly is provided at a distal end of the bearing shaft, the rotating head has a flange plate extending radially and inwardly, and the flange plate rotatably cooperates with the bearing shaft and is axially limited by the block.

In one embodiment, in the third movement path, a rotation angle of the lamp cap is smaller than or equal to 180°.

In one embodiment, a light emitter is provided on the lamp pole.

In one embodiment, the lamp further includes a lamp socket, and the first lamp pole is rotatably mounted in the lamp socket.

In one embodiment, a protruding post is provided in the lamp socket, and a gap matched with the protruding post is provided at a mounting end of the first lamp pole so that the first lamp pole is movable towards or away from the lamp socket.

In one embodiment, a rotation angle between the first lamp pole and the lamp socket is smaller than or equal to 90°.

In one embodiment, the lamp cap includes a light guide element and a light source eccentrically disposed within the light guide element.

In one embodiment, the light guide element includes a first reflecting area with a slope face and a second reflecting area with a plurality of stepped faces, the first reflecting area is adjacent to the light source and guides light of the light source to the second reflecting area, the second reflecting area extends away from the light source, and the plurality of stepped faces of the second reflecting area respectively guide light from the first reflecting area to exit the lamp cap.

As compared to the prior art, the present application has the following benefits: the lamp cap of the lamp according to the present application has two different movement paths. Thus, in use of the lamp, it reduces the limit to adjustment of the position of the lamp cap and expands the usage scenario and the lighting range of the lamp. Furthermore, when the lamp cap is a polarized lamp cap, the lamp can be used as a polarized desk lamp. As for the polarized desk lamp, a first movement path and a second movement path of the polarized lamp cap assist the user in moving the lighting range of the lamp to a desired position more conveniently, thus providing the user with significant convenience in use.

What described above are only embodiments of the present application, but are not intended to limit the present application. Various modifications and changes can be made to the present application for those of skill in the art. Any modifications, equivalents, improvements and the like made within the spirit and the principle of the present application shall all be covered within the scope of the claims of the present application.

The invention claimed is:

1. A lamp, comprising:

a bracket assembly and a lamp cap movably mounted on the bracket assembly, wherein the bracket assembly comprises a plurality of lamp poles movably connected so that the lamp cap moves in a first movement path thereof, the lamp cap is configured to move in a second movement path thereof relative to the lamp pole carrying the lamp cap, and the first movement path is different from the second movement path;

wherein the plurality of lamp poles comprise a first lamp pole and a second lamp pole movably connected, the lamp cap is movably connected to the second lamp pole;

wherein the first lamp pole and the second lamp pole are connected through a first pivot, the lamp cap is connected to the second lamp pole through a second pivot;

wherein the second lamp pole comprises a lamp pole body, the lamp pole body has a head end connected to the first lamp pole through the first pivot and has a tail end rotatably provided with a rotating head, the lamp cap is connected to the rotating head through the second pivot; and wherein the rotating head has a rotation axis parallel to the axial direction of the second lamp pole so that the lamp cap moves along a third movement path thereof, and the third movement path is different from the first movement path and the second movement path.

2. The lamp according to claim 1, wherein the lamp cap moves towards or away from the first lamp pole in the first movement path, and the lamp cap rotates about a first axis thereof in the second movement path.

3. The lamp according to claim 2, wherein the first pivot is perpendicular to an axial direction of the first lamp pole and the second lamp pole so that the lamp cap rotates in the first movement path thereof, and the second pivot is perpendicular to the axial direction of the second lamp pole so that the lamp cap rotates in the second movement path thereof.

4. The lamp according to claim 3, wherein the first lamp pole is a vertical lamp pole, the second lamp pole has a first end connected to the first lamp pole through the first pivot, and the lamp cap is connected to a second end of the second lamp pole through the second pivot.

5. The lamp according to claim 4, wherein a rotation angle between the second lamp pole and the first lamp pole is greater than or equal to 0° but smaller than or equal to 300°;

and a rotation angle between the lamp cap and the second lamp pole is greater than or equal to 0° but smaller than or equal to 300°.

6. The lamp according to claim 4, further comprising a bearing shaft that is axially mounted at the tail end of the lamp pole body, wherein a block extending radially and outwardly is provided at a distal end of the bearing shaft, the rotating head has a flange plate extending radially and inwardly, and the flange plate rotatably cooperates with the bearing shaft and is axially limited by the block.

7. The lamp according to claim 6, wherein in the third movement path, a rotation angle of the lamp cap is smaller than or equal to 180°.

8. The lamp according to claim 4, wherein the lamp further comprises a lamp socket, and the first lamp pole is rotatably mounted in the lamp socket.

9. The lamp according to claim 8, wherein a protruding post is provided in the lamp socket, and a gap matched with the protruding post is provided at a mounting end of the first lamp pole so that the first lamp pole is movable towards or away from the lamp socket.

10. The lamp according to claim 9, wherein a rotation angle between the first lamp pole and the lamp socket is smaller than or equal to 90°.

11. The lamp according to claim 1, wherein a light emitter is provided on the lamp pole.

12. The lamp according to claim 1, wherein the lamp cap comprises a light guide element and a light source eccentrically disposed within the light guide element.

13. The lamp according to claim 12, wherein the light guide element comprises a first reflecting area with a slope face and a second reflecting area with a plurality of stepped faces, the first reflecting area is adjacent to the light source and guides light of the light source to the second reflecting area, the second reflecting area extends away from the light source, and the plurality of stepped faces of the second reflecting area respectively guide light from the first reflecting area to exit the lamp cap.

* * * * *